US008113387B2

(12) United States Patent
Huang

(10) Patent No.: US 8,113,387 B2
(45) Date of Patent: Feb. 14, 2012

(54) WATER DISPENSER FOR A KITCHEN WALL PARTITION

(76) Inventor: Jung-Shin Huang, Flushing, NY (US)

( * ) Notice: Subject to any disclaimer, the term of this patent is extended or adjusted under 35 U.S.C. 154(b) by 394 days.

(21) Appl. No.: 12/238,173

(22) Filed: Sep. 25, 2008

(65) Prior Publication Data

US 2010/0072226 A1 Mar. 25, 2010

(51) Int. Cl.
*B67D 7/80* (2010.01)

(52) U.S. Cl. ..... 222/146.2; 222/1; 222/52; 222/146.5; 222/189.06; 222/192; 4/678; 4/679

(58) Field of Classification Search ..... 222/146.2, 222/146.1, 146.5, 1, 52, 189.06, 146.4, 192, 222/129.1, 183, 108; 137/337, 341; 4/625–626, 4/630, 678, 679
See application file for complete search history.

(56) References Cited

U.S. PATENT DOCUMENTS 2,786,211 A * 3/1957 Culver, Jr. ..... 4/626
3,055,810 A * 9/1962 Skow ..... 203/2
4,263,498 A * 4/1981 Meyers ..... 392/451
4,697,614 A * 10/1987 Powers et al. ..... 137/337
5,182,822 A * 2/1993 Cyr et al. ..... 4/625
5,349,992 A * 9/1994 Gallo et al. ..... 141/18
5,465,438 A * 11/1995 Allman et al. ..... 4/626
5,704,078 A * 1/1998 Chandler ..... 4/449
6,871,675 B1 * 3/2005 Marszalec et al. ..... 141/82
2005/0166313 A1 * 8/2005 Permenter ..... 4/625
2009/0000024 A1 * 1/2009 Louis et al. ..... 4/676

* cited by examiner

*Primary Examiner* — Frederick C. Nicolas
(74) *Attorney, Agent, or Firm* — Holland & Hart, LLP

(57) ABSTRACT

A water dispenser is adapted to be disposed in a kitchen wall partition that is formed with an opening and that has a sink unit disposed thereon. The water dispenser includes a housing retained in the opening, a pipe unit disposed in the housing to fluidly communicate with the sink unit, a heating unit disposed in the housing for boiling and storing water from the pipe unit, a face panel, and a control unit. The face panel is retained detachably on the housing, and has a hot water supply pipe extending from the heating unit into a dispensing cavity, and a drain unit connected to the sink unit. The control unit includes a heating circuit for controlling heating operation of the heating unit, a first valve for controlling water flow into the heating unit, and a second valve for controlling water flow through the hot water supply pipe.

29 Claims, 8 Drawing Sheets

WATER DISPENSER FOR A KITCHEN WALL PARTITION

BACKGROUND OF THE INVENTION

1. Field of the Invention

The invention relates to a water dispenser, more particularly to a water dispenser for a kitchen wall partition.

2. Description of the Related Art

It is common in most households to heat up a pot of water in the morning for making breakfast coffee. Some people boil water using electric heating pots instead of a gas stove for safety concerns. However, every time an electric heating pot is empty, it is required to manually fill the electric heating pot with water, thereby resulting in inconvenience during use.

As shown in FIG. 1, a conventional hot water dispenser 7 is adapted for use with a countertop 8. The countertop 8 is mounted with a sink unit 81 that includes a water inlet pipe 811. The conventional hot water dispenser 7 includes a faucet 71 mounted on a top side of the countertop 8 at a position adjacent to the sink unit 81, a filter unit 73 disposed under the sink unit 81 for filtering water from the water inlet 811, and a heating tank 72 disposed under the sink unit 81 for boiling water from the filter unit 73. By connecting the heating tank 72 to an electrical outlet 82 under the sink unit 81, the conventional hot water dispenser 7 can boil water directly from the water inlet pipe 811.

However, since the conventional hot water dispenser 7 is disposed adjacent to the sink unit 81 and can be easily accessed by children, children may scald themselves with boiled water while operating the conventional hot water dispenser 7.

SUMMARY OF THE INVENTION

Therefore, an object of the present invention is to provide a water dispenser that is easy to use and that is safer for children.

Another object of the present invention is to provide a kitchen assembly including a water dispenser disposed in a kitchen wall partition.

Yet another object of the present invention is to provide a method of installing a water dispenser in a kitchen wall partition.

Accordingly, a water dispenser of the present invention is adapted to be disposed in a kitchen wall partition. The kitchen wall partition is formed with an opening for retaining the water dispenser therein and has a sink unit disposed thereon at a position below the opening. The sink unit includes a sink body, a drain pipe connected to the sink body, and a water inlet pipe. The water dispenser comprises a housing, a pipe unit, a heating unit, a face panel, and a control unit. The housing is adapted to be retained in the opening of the kitchen wall portion, and has a front side that is formed with a panel engaging hole. The pipe unit is disposed in the housing, and has a water inlet that is adapted for fluidly communicating with the water inlet pipe, and a first water outlet through which water entering the water inlet flows. The heating unit is disposed in the housing, and has a connecting water inlet that is fluidly communicated with the first water outlet of the pipe unit, a heating tank for boiling and storing water from the connecting water inlet, and a hot water outlet that is fluidly communicated with the heating tank. The face panel is retained detachably in the panel engaging hole at the front side of the housing, and has a dispensing cavity, a hot water supply pipe that has one end fluidly communicating with the hot water outlet of the heating unit and an opposite end extending into the dispensing cavity, and a drain unit that is adapted for fluidly communicating with the drain pipe of the sink unit. The control unit is disposed in the housing, and includes a heating circuit for controlling heating operation of the heating tank to boil the water therein, a first valve for controlling water flow from the first water outlet of the pipe unit to the connecting water inlet of the heating unit, and a second valve for controlling water flow through the hot water supply pipe of the face panel.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
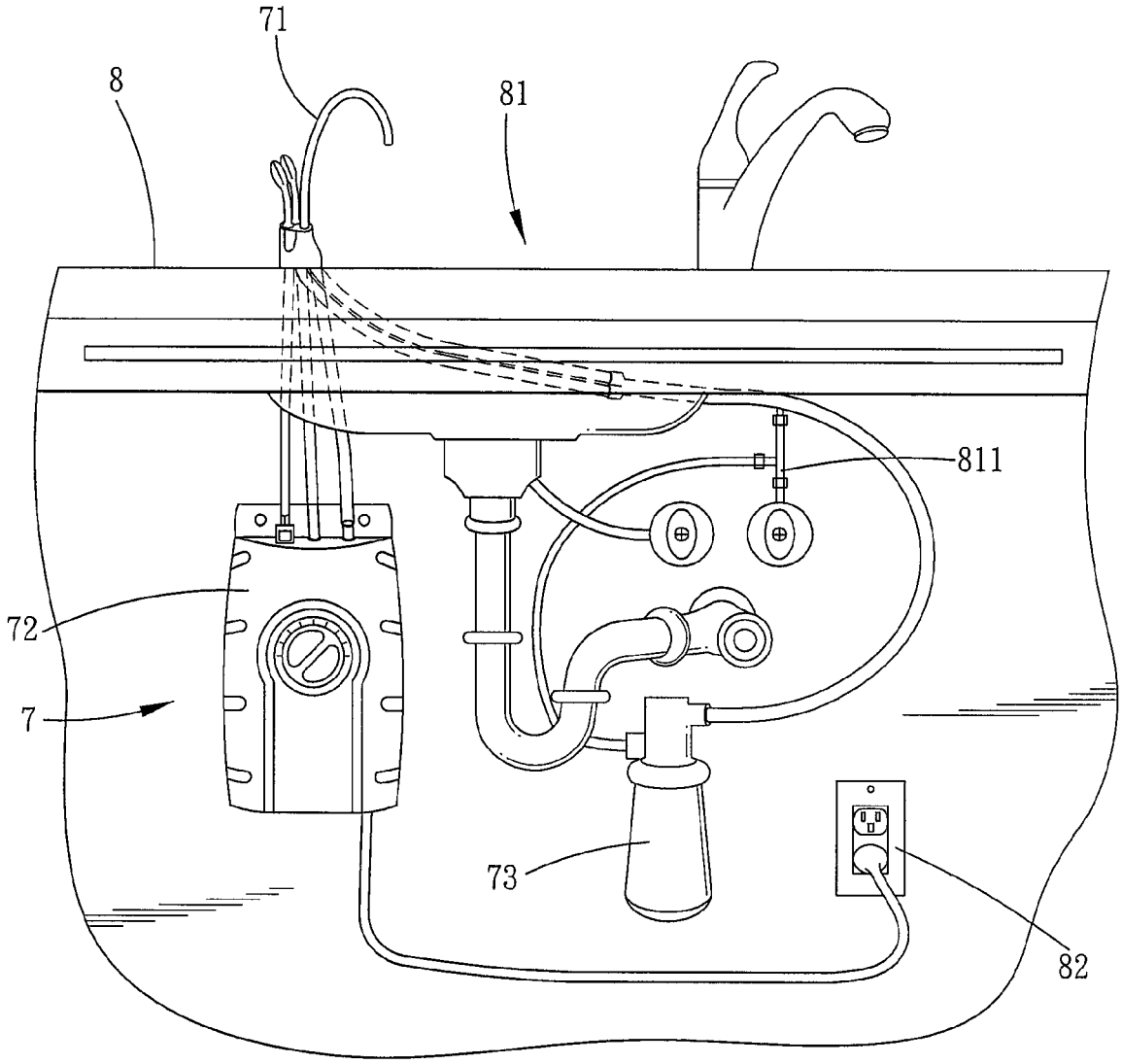
FIG. 1 PRIOR ART
FIG. 1 is a schematic view of a conventional hot water dispenser.
Figure 2:
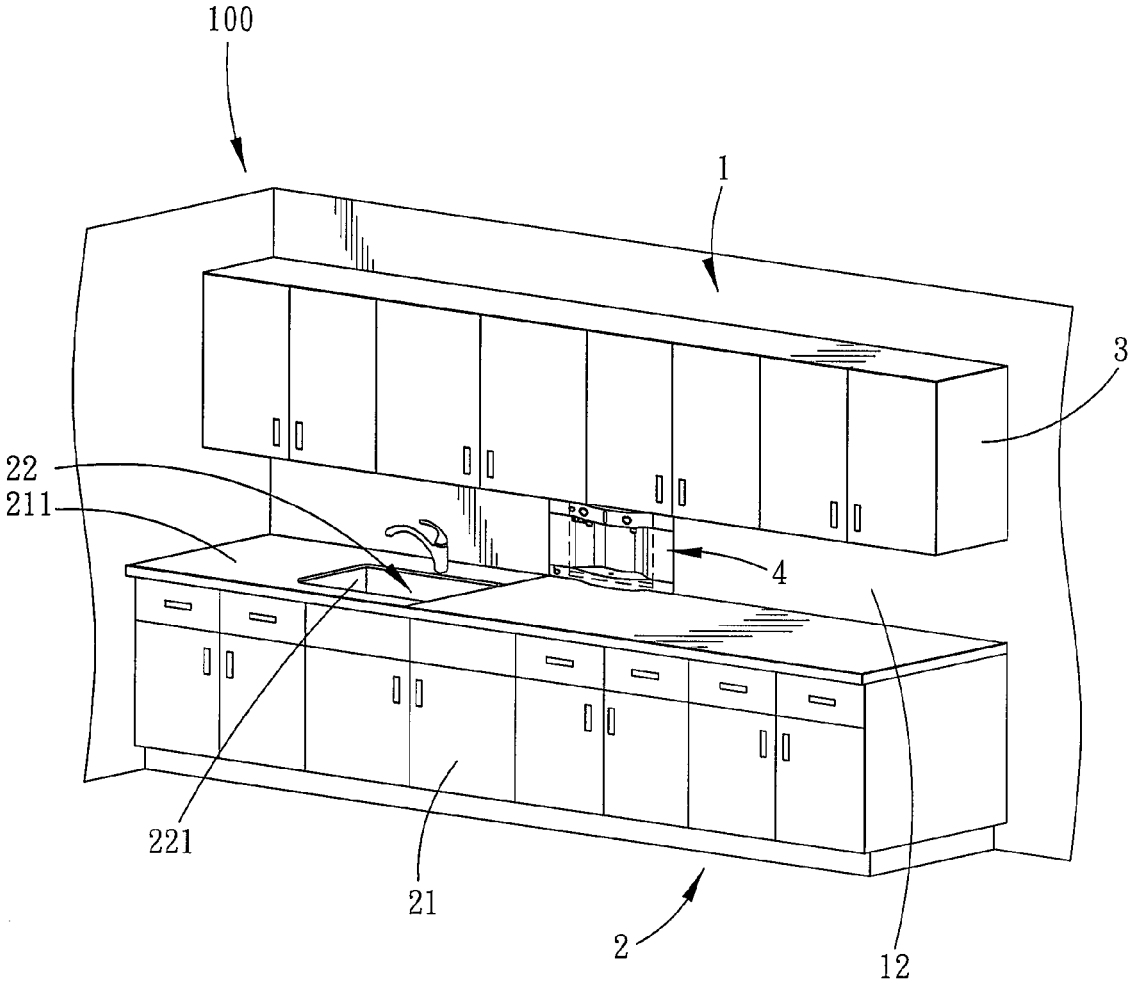
FIG. 2 is a perspective view of a preferred embodiment of a kitchen assembly according to the present invention.
Figure 3:
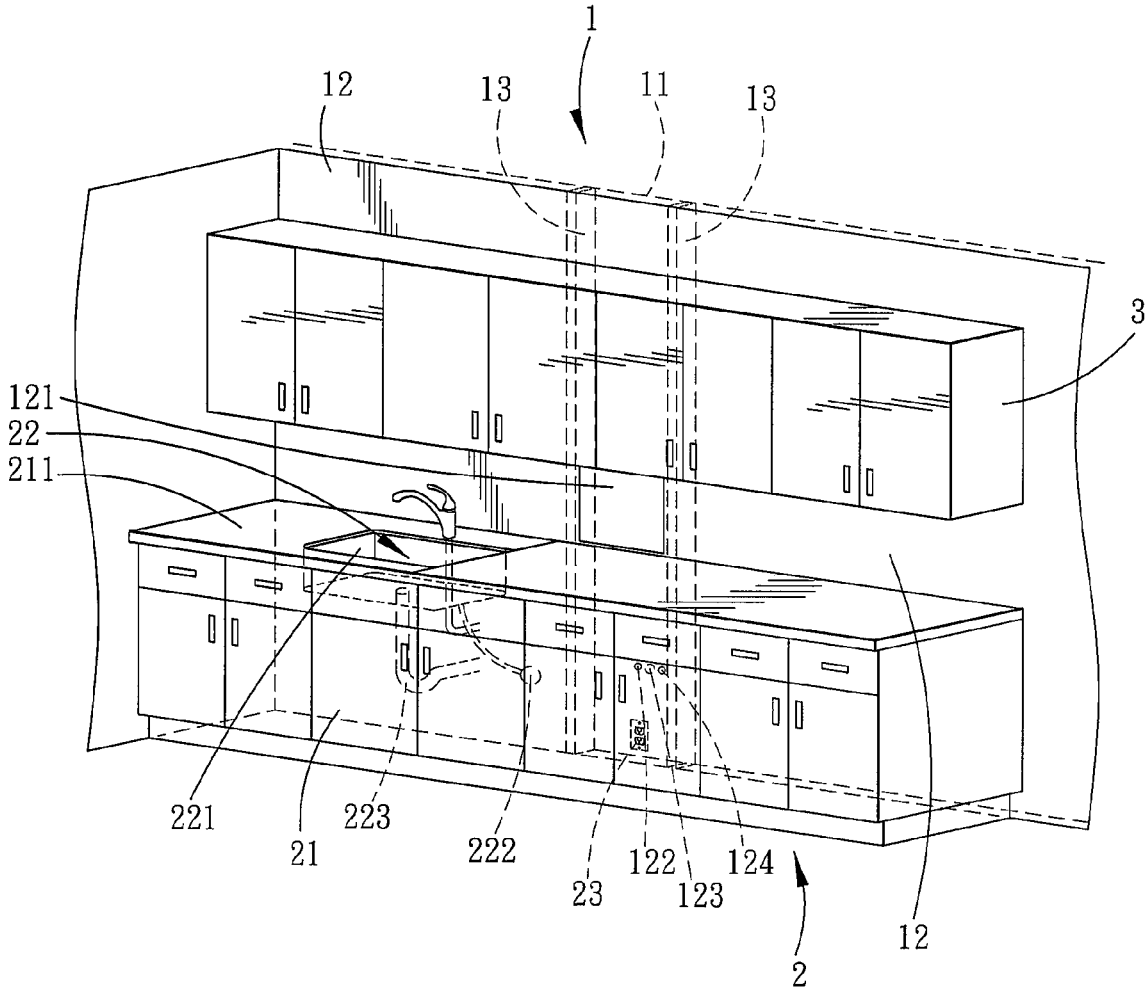
FIG. 3 is another perspective view of the preferred embodiment of the kitchen assembly, illustrating a kitchen wall partition and a sink unit.
Figure 4:
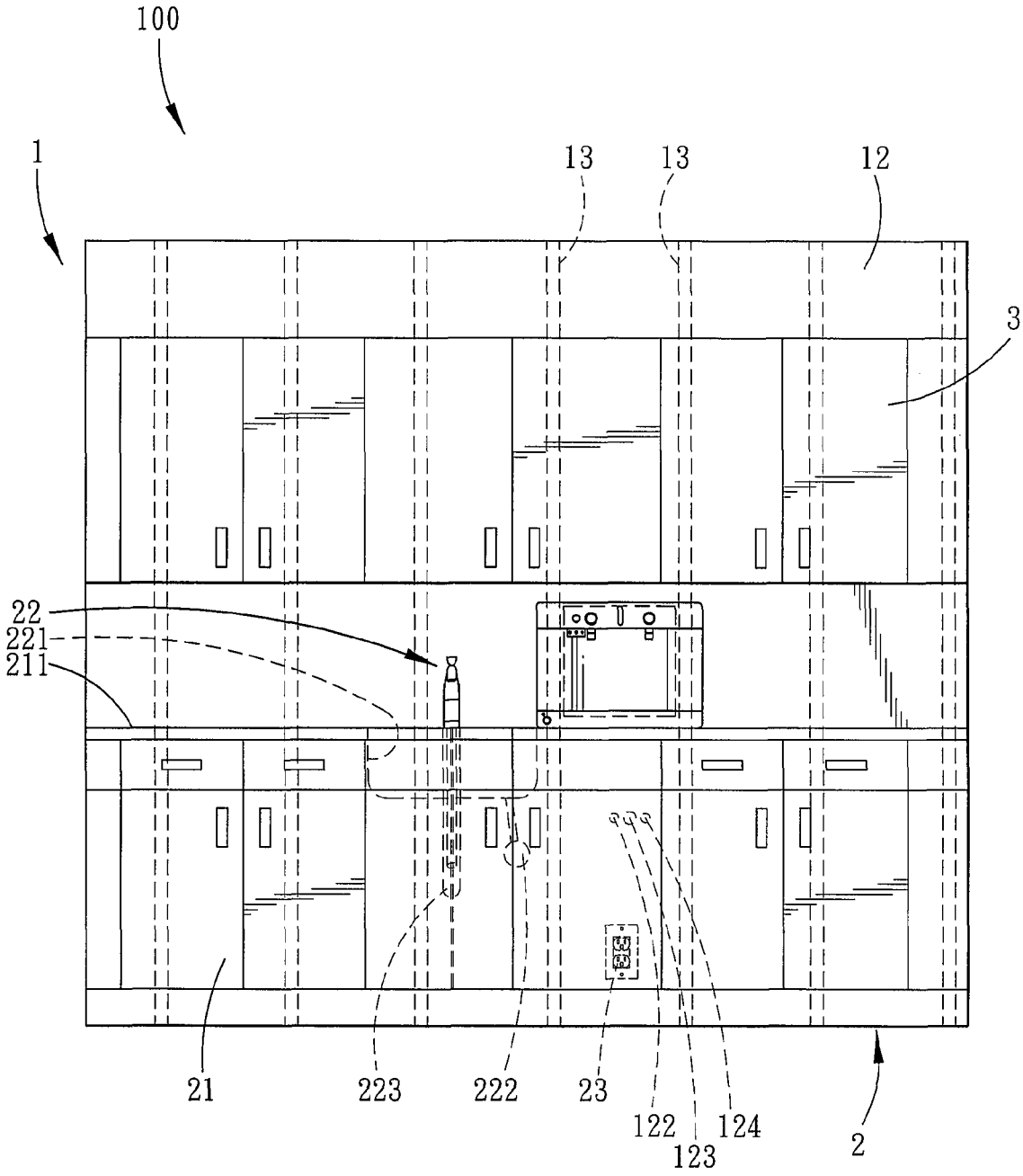
FIG. 4 is a schematic front view of the preferred embodiment of the kitchen assembly.

As shown in FIGS. 2 to 4, the preferred embodiment of a kitchen assembly 100 according to the present invention is adapted to be disposed between a ceiling (not shown) and a floor (not shown), and comprises a kitchen wall partition 1, a sink unit 22, a cabinet unit 2, and a water dispenser 4.

The kitchen wall partition 1 includes parallel exterior and interior wall panels 11, 12 that are adapted to be disposed between the ceiling and the floor and that are provided six or eight inches apart, and a plurality of spaced apart posts 13 that are disposed between the exterior and interior wall panels 11, 12 and that are disposed to extend vertically from the floor to the ceiling. Each of the posts 13 has a thickness of six or eight inches between the exterior and interior wall panels 11, 12. The distance between adjacent ones of the posts 13 is 14 inches. Assuming that the posts 13 are two inches wide, the distance between centers of adjacent ones of the posts 13 is 16 inches. The interior wall panel 12 is mounted with an electrical outlet 23, and is formed with an opening 121 between an adjacent pair of the posts 13. In this embodiment, the opening 121 is a square and has a side length of 14 inches. The interior wall panel 12 is further formed with first, second, and third through holes 122, 123, 124 at positions below the opening 121. The respective diameters of the first, second, and third through holes 122, 123, 124 are ⅜ inch, 1 inch, and ⅜ inch.

The cabinet unit 2 is disposed on the interior wall panel 12 of the kitchen wall partition 1, and includes a base cabinet 21 disposed on the floor, a countertop 211 provided on the base cabinet 21, and a top cabinet 3 disposed above the base cabinet 21.

The sink unit 22 is mounted on the interior wall panel 12 of the kitchen wall partition 1 at a position below the opening 121, and includes a sink body 221 provided in the countertop 211 of the cabinet unit 2, a drain pipe 223 connected to the sink body 221, and a water inlet pipe 222, such that the opening 121 is formed between the top cabinet 3 of the cabinet unit 2 and the sink unit 22.

Figure 4A:
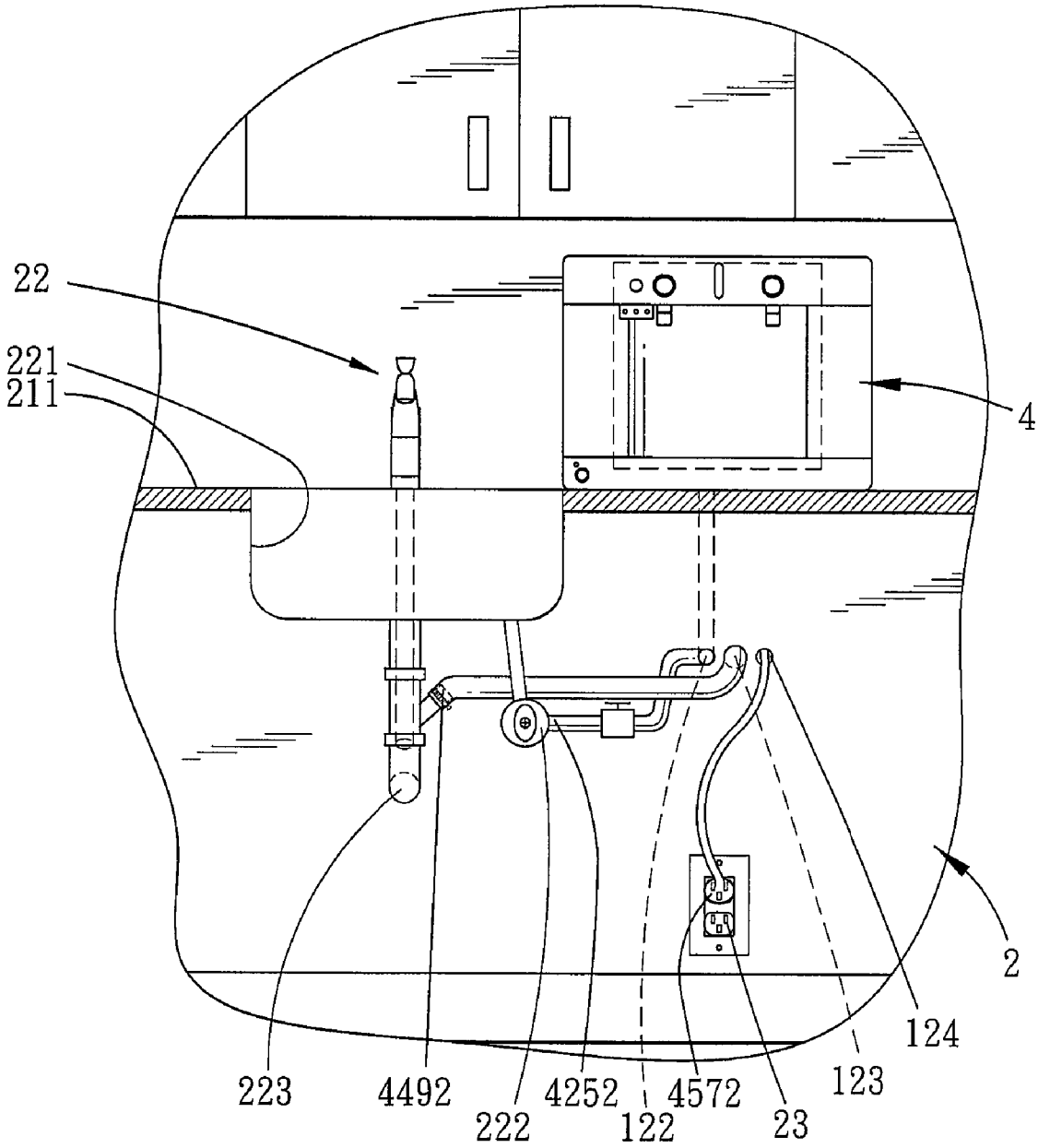
FIG. 4A is a fragmentary schematic front view of the preferred embodiment of the kitchen assembly.
Figure 5:
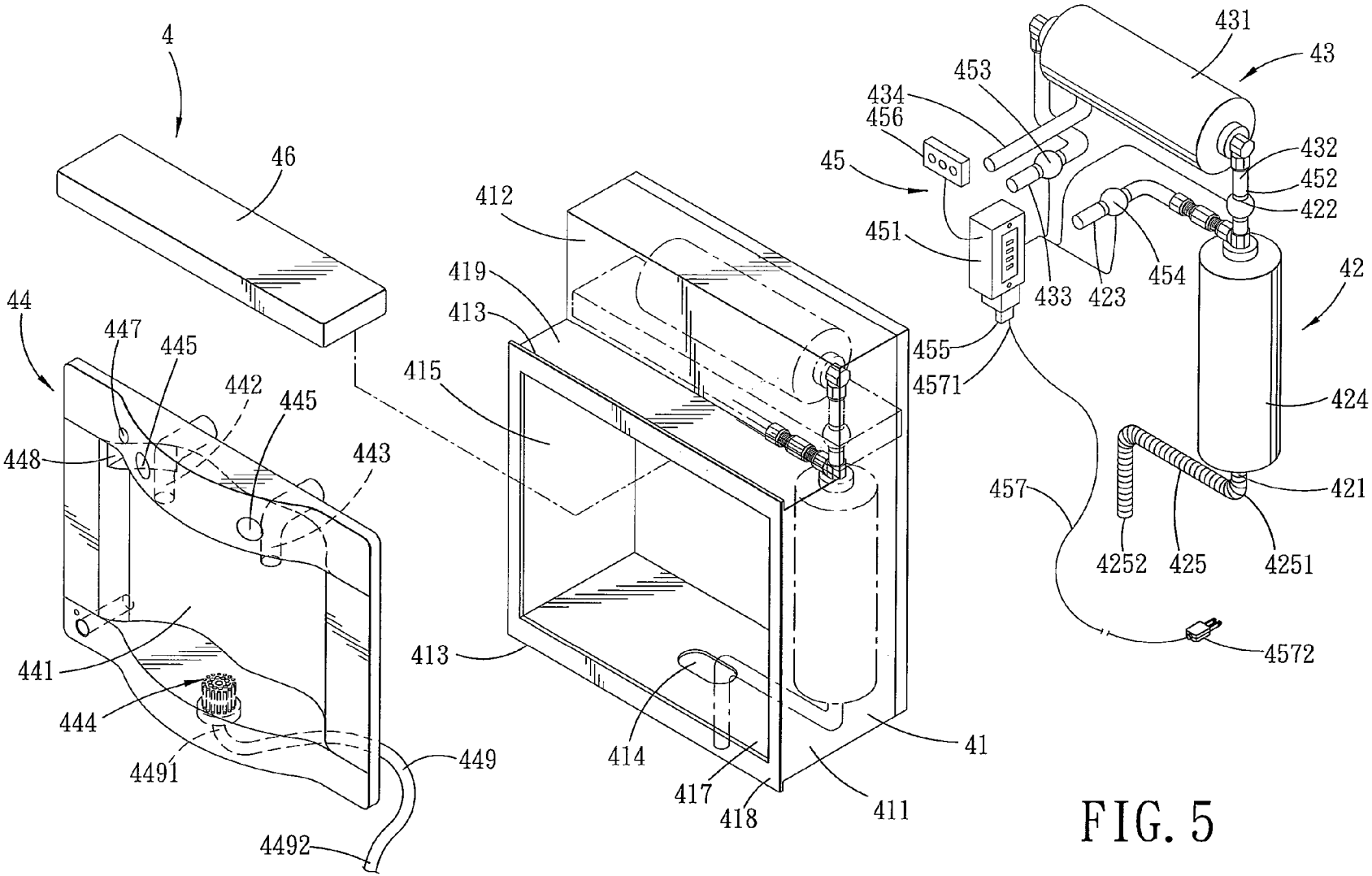
FIG. 5 is an exploded perspective view of a water dispenser of the preferred embodiment.

Referring to FIGS. 4A and 5, the water dispenser 4 comprises a housing 41, a pipe unit 42, a heating unit 43, a face panel 44, a control unit 45, and a heat insulating component 46.

Figure 6:
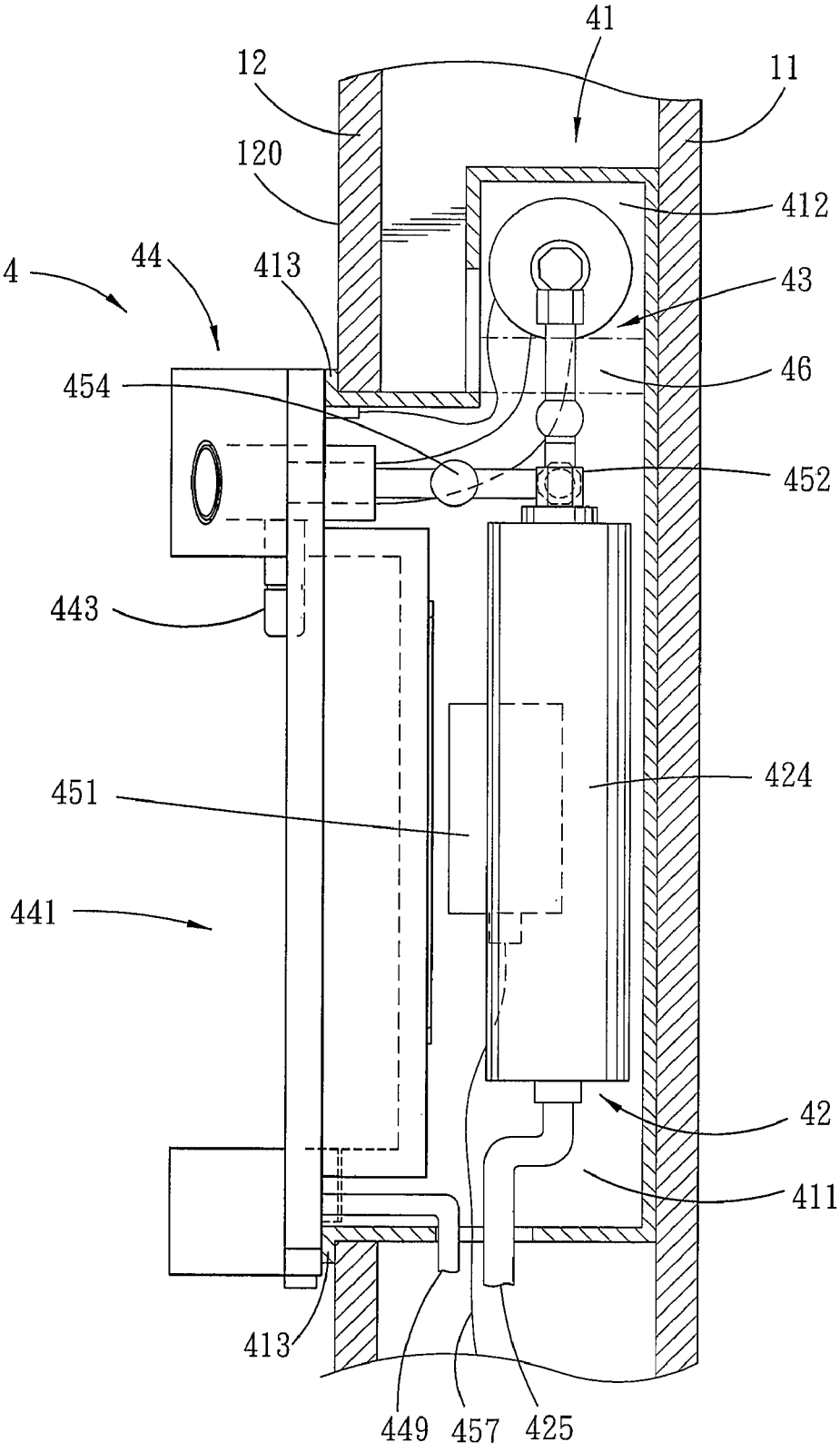
FIG. 6 is a fragmentary schematic partly sectional view of the kitchen assembly.

The housing 41 is retained in the opening 121 in the interior wall panel 12 of the kitchen wall partition 1, and has a main housing portion 411 and a secondary housing portion 412. The main housing portion 411 has a front side 418 formed with a panel engaging hole 415, and a bottom side 417 formed with a pipe hole 414. The secondary housing portion 412 extends upwardly from a top side 419 of the main housing portion 411. In this embodiment, the main housing portion 411 has a width of 14 inches, a height of 14 inches, and a depth of 5 inches. The secondary housing portion 412 has a width of 14 inches, a height of 3 inches, and a depth of 3 inches. In this embodiment, the main housing portion 411 further has a pair of abutment portions 413 that protrude respectively from top and bottom edges thereof at the front side 418. Each of the abutment portions 413 is configured as an elongated plate and is disposed for abutting against an outer surface 120 of the interior wall panel 12 of the kitchen wall partition 1, as best shown in FIG. 6.

The pipe unit 42 is disposed in the main housing portion 411 of the housing 41, and has a water inlet 421, a first connecting pipe 425 that has a first pipe end 4251 extending through the first through hole 122 in the interior wall panel 12 of the kitchen wall partition 1 and fluidly communicated with the water inlet 421 and a second pipe end 4252 fluidly communicated with the water inlet pipe 222 of the sink unit 22, first and second water outlets 422, 423 through which water entering the water inlet 421 flows, and a filter element 424 that is disposed among the water inlet 421, the first water outlet 422, and the second water outlet 423, and that is disposed for filtering water flowing through the first and second water outlets 422, 423.

The heating unit 43 is disposed in the secondary housing portion 412 of the housing 41, and has a connecting water inlet 432 that is fluidly communicated with the first water outlet 422 of the pipe unit 42, a heating tank 431 that is disposed for boiling and storing water from the connecting water inlet 432, a hot water outlet 433 that is fluidly communicated with the heating tank 431, and a steam pipe 434 that is connected to the heating tank 431 for exhaust of steam in the heating tank 431.

The face panel 44 is retained detachably in the panel engaging hole 415 at the front side 418 of the main housing portion 411 of the housing 41, and has a dispensing cavity 441, a hot water supply pipe 442 that has one end fluidly communicating with the hot water outlet 433 of the heating unit 43 and an opposite end extending into the dispensing cavity 441, a cool water supply pipe 443 that has one end fluidly communicating with the second water outlet 423 of the pipe unit 42 and an opposite end extending into the dispensing cavity 441, a drain unit 444, a steam outlet 447 that is fluidly communicated with the steam pipe 434 of the heating unit 43, and a second connecting pipe 449 that has a first pipe end 4491 fluidly communicated with the drain unit 444 and a second pipe end 4492 extending through the second through hole 123 in the interior wall panel 12 of the kitchen wall partition 1 and fluidly communicated with the drain pipe 223 of the sink unit 22.

The control unit 45 is disposed in the main housing portion 411 of the housing 41, and includes a heating circuit 451 for controlling heating operation of the heating tank 431 of the heating unit 43 to boil the water therein, a first valve 452 for controlling water flow from the first water outlet 422 of the pipe unit 42, a second valve 453 for controlling water flow through the hot water supply pipe 442 of the face panel 44, a third valve 454 for controlling water flow through the cool water supply pipe 443 of the face panel 44, a safety switch 455 for automatically deactivating the heating circuit 451 when the heating circuit 451 is overheated, a power cable 457 having a first cable end 4571 for connecting to the heating circuit 451 and a second cable end 4572 extending through the third through hole 124 in the interior wall panel 12 of the kitchen wall partition 1 for connecting to the electrical outlet 23 of the kitchen wall partition 1, and an indicator unit 456 for indicating working status of the control unit 45. The face panel 44 further has a status viewing portion 448 at a position corresponding to the indicator unit 456 so as to permit viewing of the indicator unit 456 therethrough. In this embodiment, each of the first, second and third valves 452, 453, 454 is an electromagnetic valve.

The face panel 44 further has two buttons 445 for controlling operations of the second and third valves 453, 454 of the control unit 45, respectively. In this embodiment, the water dispenser 4 further includes a known safety lock (not shown). Water is dispensed upon pressing the buttons 445 only when the safety lock is unlocked, thereby enhancing safety during use.

The heat insulating component 46 is disposed in the housing 41 under the heating unit 43 for providing insulation to the heating unit 43.

Figure 7:
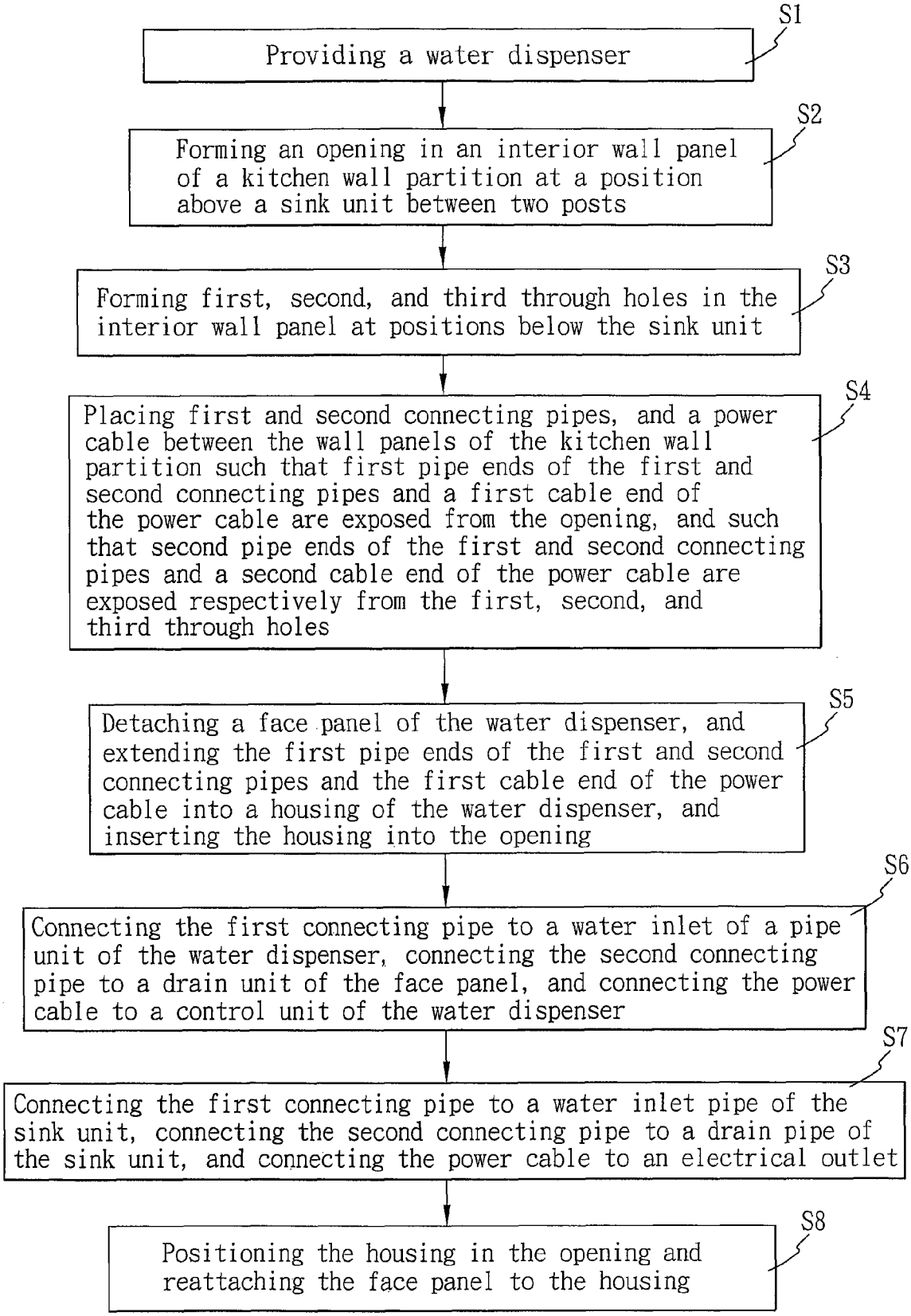
FIG. 7 is a flow chart of a preferred embodiment of a method of installing the water dispenser in the kitchen wall partition according to the present invention.

FIG. 7 illustrates the method of installing the water dispenser 4 in the kitchen wall partition 1 according to this invention. The method comprises steps S1 to S8.

The first step S1 is to provide the water dispenser 4. The step S2 is to form the square opening 121 in the interior wall panel 12 of the kitchen wall partition 1 at a position above the sink unit 22 between an adjacent pair of the posts 13. The opening 121 is formed with a side length of 14 inches so as to permit retention of the water dispenser 4 in the kitchen wall partition 1.

The step S3 is to form the first, second and third through holes 122, 123, 124 in the interior wall panel 12 at positions below the sink body 221 of the sink unit 22.

The step S4 is to place the first connecting pipe 425, the second connecting pipe 449, and the power cable 457 between the exterior and interior wall panels 11, 12 of the kitchen wall partition 1 such that the first pipe end 4251 of the first connecting pipe 425, the first pipe end 4491 of the second connecting pipe 449, and the first cable end 4571 of the power cable 457 are exposed from the opening 121, and such that the second pipe end 4252 of the first connecting pipe 425, the second pipe end 4492 of the second connecting pipe 449, and the second cable end 4572 of the power cable 457 are exposed respectively from the first, second, and third through holes 122, 123, 124 in the interior wall panel 12.

The step S5 is to detach the face panel 44 from the housing 41, to extend the first pipe end 4251 of the first connecting pipe 425, the first pipe end 4491 of the second connecting pipe 449, and the first cable end 4571 of the power cable 457 into the housing 41 of the water dispenser 4 via the pipe hole 414, and to insert the housing 41 into the opening 121.

The step S6 is to connect the first pipe end 4251 of the first connecting pipe 425 to the water inlet 421 of the pipe unit 42, to connect the first pipe end 4491 of the second connecting pipe 449 to the drain unit 444 of the face panel 44, and to connect the first cable end 4571 of the power cable 457 to the control unit 45.

The step S7 is to connect the second pipe end 4251 of the first connecting pipe 425 to the water inlet pipe 222 of the sink unit 22, to connect the second pipe end 4492 of the second connecting pipe 449 to the drain pipe 223 of the sink unit 22, and to connect the second cable end 4572 of the power cable 457 to the electrical outlet 23 on the interior wall panel 12, followed by a power test and a water dispensing test.

The step S8 is to position the housing 41 in the opening 121 by abutting the abutment portions 413 of the housing 4 against the outer surface 120 of the interior wall panel 12 of the kitchen wall partition 1, and to attach the face panel 44 to the housing 41. It should be noted that, for firmly securing the housing 41 to the kitchen wall partition 1, the housing 41 may be fastened to the adjacent pair of posts 13 through fasteners, such as screws, before reattaching the face panel 44 to the housing 41.

Since the water dispenser 4 of this invention is disposed within the kitchen wall partition 1 instead of being provided directly on the countertop 211, the water dispenser 4 does not occupy the working area of the countertop 211. Moreover, since the water dispenser 4 of the invention is disposed on the interior wall panel 12 of the kitchen wall partition 1 above the base cabinet 21 of the cabinet unit 2, it is not easily accessed by children.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A water dispenser adapted to be disposed in a kitchen wall partition, the kitchen wall partition being formed with an opening for retaining said water dispenser therein and having a sink unit disposed thereon at a position below the opening, the sink unit including a sink body, a drain pipe connected to the sink body, and a water inlet pipe, said water dispenser comprising:

a housing adapted to be retained in the opening of the kitchen wall portion and having a front side that is formed with a panel engaging hole;

a pipe unit disposed in said housing and having a water inlet that is adapted for fluidly communicating with the water inlet pipe, and a first water outlet through which water entering said water inlet flows;

a heating unit disposed in said housing and having a connecting water inlet that is fluidly communicated with said first water outlet of said pipe unit, a heating tank for boiling and storing water from said connecting water inlet, and a hot water outlet that is fluidly communicated with said heating tank;

a face panel retained detachably in said panel engaging hole at said front side of said housing, and having a dispensing cavity, a hot water supply pipe that has one end fluidly communicating with said hot water outlet of said heating unit and an opposite end extending into said dispensing cavity, and a drain unit that is adapted for fluidly communicating with the drain pipe of the sink unit; and a control unit disposed in said housing and including a heating circuit for controlling heating operation of said heating tank to boil the water therein, a first valve for controlling water flow from said first water outlet of said pipe unit to said connecting water inlet of said heating unit, and a second valve for controlling water flow through said hot water supply pipe of said face panel.

2. The water dispenser as claimed in claim 1, wherein said housing further has an abutment portion that protrudes from one edge thereof at said front side and that is adapted to abut against an outer surface of the kitchen wall partition.

3. The water dispenser as claimed in claim 2, wherein said abutment portion of said housing is configured as an elongated plate.

4. The water dispenser as claimed in claim 1, the kitchen wall partition being a hollow partition, wherein said housing has a main housing portion formed with said panel engaging hole, adapted to be retained in the opening of the kitchen wall portion, and retaining said pipe unit and said control unit therein, and a secondary housing portion extending upwardly from a top side of said main housing portion and retaining said heating unit therein.

5. The water dispenser as claimed in claim 1, wherein said control unit further includes a safety switch for automatically deactivating said heating circuit when said heating circuit is overheated.

6. The water dispenser as claimed in claim 1, wherein said pipe unit further has a filter element disposed between said water inlet and said first water outlet.

7. The water dispenser as claimed in claim 1, wherein:

said heating unit further has a steam pipe connected to said heating tank for exhaust of steam in said heating tank; and said face panel further has a steam outlet fluidly communicating with said steam pipe of said heating unit.

8. The water dispenser as claimed in claim 1, the kitchen wall partition being further mounted with an electrical outlet, wherein said control unit further includes a power cable that is adapted for connecting to the electrical outlet.

9. The water dispenser as claimed in claim 1, further comprising a heat insulating component disposed in said housing for providing heat insulation to said heating unit.

10. The water dispenser as claimed in claim 1, wherein:

said control unit further includes an indicator unit for indicating working status of said control unit; and said face panel further has a status viewing portion at a position corresponding to said indicator unit of said control unit so as to permit viewing of said indicator unit therethrough.

11. The water dispenser as claimed in claim 1, wherein said pipe unit further includes a second water outlet through which water entering said water inlet flows, said face panel further having a cool water supply pipe that has one end fluidly communicating with said second water outlet of said pipe unit and an opposite end extending into said dispensing cavity, said control unit further including a third valve for controlling water flow through said cool water supply pipe of said face panel.

12. A kitchen assembly adapted to be disposed between a ceiling and a floor, said kitchen assembly comprising:

a kitchen wall partition including exterior and interior wall panels that are adapted to be disposed between the ceiling and the floor, and a pair of parallel posts that are disposed between said exterior and interior wall panels and that are disposed to extend vertically from the floor to the ceiling, said interior wall panel being formed with an opening between said posts; and a water dispenser including a housing retained in said opening of said interior wall panel and having a front side that is formed with a panel engaging hole, a pipe unit disposed in said housing, a heating unit disposed in said housing and having a connecting water inlet that is fluidly communicated with said pipe unit, a heating tank for boiling and storing water from said connecting water inlet, and a hot water outlet that is fluidly communicated with said heating tank, a face panel retained detachably in said panel engaging hole at said front side of said housing, and having a dispensing cavity, and a hot water supply pipe that has one end fluidly communicating with said hot water outlet of said heating unit and an opposite end extending into said dispensing cavity, and a control unit disposed in said housing and including a heating circuit for controlling heating operation of said heating tank to boil the water therein, a first valve for controlling water flow from said first water outlet of said pipe unit to said connecting water inlet of said heating unit, and a second valve for controlling water flow through said hot water supply pipe of said face panel.

13. The kitchen assembly as claimed in claim 12, further comprising a sink unit disposed on said interior wall panel at a position below said opening, said sink unit including a sink body, a drain pipe connected to said a sink body, and a water inlet pipe, said pipe unit having a water inlet that is fluidly communicated with said water inlet pipe, said face panel further having a drain unit that is fluidly communicated with said drain pipe.

14. The kitchen assembly as claimed in claim 13, further comprising a top cabinet mounted on said interior wall panel, said opening being formed between said sink unit and said top cabinet.

15. The kitchen assembly as claimed in claim 12, wherein said housing further has an abutment portion that protrudes from one edge thereof at said front side and that is adapted to abut against an outer surface of said interior wall panel of said kitchen wall partition.

16. The kitchen assembly as claimed in claim 15, wherein said abutment portion of said housing is configured as an elongated plate.

17. The kitchen assembly as claimed in claim 12, wherein said housing has a main housing portion formed with said panel engaging hole, retained in said opening of said interior wall panel of said kitchen wall portion, and retaining said pipe unit and said control unit therein, and a secondary housing portion extending upwardly from a top side of said main housing portion and retaining said heating unit therein.

18. The kitchen assembly as claimed in claim 12, wherein said control unit further includes a safety switch for automatically deactivating said heating circuit when said heating circuit is overheated.

19. The kitchen assembly as claimed in claim 12, wherein said pipe unit has a filter element for filtering water supplied to said heating tank.

20. The kitchen assembly as claimed in claim 12, wherein:

said heating unit further has a steam pipe connected to said heating tank for exhaust of steam in said heating tank; and said face panel further has a steam outlet fluidly communicating with said steam pipe of said heating unit.

21. The kitchen assembly as claimed in claim 12, wherein said kitchen wall partition further includes an electrical outlet mounted on said interior wall panel, and said control unit further includes a power cable for connecting to said electrical outlet.

22. The kitchen assembly as claimed in claim 12, wherein said water dispenser further includes a heat insulating component disposed in said housing for providing heat insulation to said heating unit.

23. The kitchen assembly as claimed in claim 12, wherein:

said control unit further includes an indicator unit for indicating working status of said control unit; and said face panel further has a status viewing portion at a position corresponding to said indicator unit of said control unit so as to permit viewing of said indicator unit therethrough.

24. The kitchen assembly as claimed in claim 12, wherein said face panel further has a cool water supply pipe that has one end fluidly communicating with said pipe unit and an opposite end extending into said dispensing cavity, said control unit further including a third valve for controlling water flow through said cool water supply pipe of said face panel.

25. A method of installing a water dispenser in a kitchen wall partition, the kitchen wall partition including exterior and interior wall panels, and a pair of posts extending vertically between the exterior and interior wall panels, the interior wall panel having a sink unit disposed thereon, the sink unit including a sink body, a drain pipe connected to the sink body, and a water inlet pipe, said method comprising the steps of:

(A) providing a water dispenser that includes a housing having a front side that is formed with a panel engaging hole, a pipe unit disposed in said housing and having a water inlet, and a first water outlet through which water entering said water inlet flows, a heating unit disposed in said housing and having a connecting water inlet that is fluidly communicated with said first water outlet of said pipe unit, a heating tank for boiling and storing water from said connecting water inlet, and a hot water outlet that is fluidly communicated with said heating tank, a face panel retained detachably in said panel engaging hole at said front side of said housing, and having a dispensing cavity, a hot water supply pipe that has one end fluidly communicating with said hot water outlet of said heating unit and an opposite end extending into said dispensing cavity, and a drain unit, and a control unit disposed in said housing and including a heating circuit for controlling heating operation of said heating tank to boil the water therein, a first valve for controlling water flow from said first water outlet of said pipe unit to said connecting water inlet of said heating unit, and a second valve for controlling water flow through said hot water supply pipe of said face panel;

(B) forming an opening in the interior wall panel of the kitchen wall partition at a position above the sink unit between the posts, the opening having a size sufficient to permit retention of the water dispenser in the kitchen wall partition;

(C) forming first and second through holes in the interior wall panel of the kitchen wall partition at positions below the sink body;

(D) placing first and second connecting pipes between the exterior and interior wall panels of the kitchen wall partition such that first pipe ends of the first and second connecting pipes are exposed from the opening in the interior wall panel of the kitchen wall partition, and such that second pipe ends of the first and second connecting pipes are exposed respectively from the first and second through holes in the interior wall panel;

(E) extending the first pipe ends of the first and second connecting pipes into the housing of the water dispenser, and inserting the housing of the water dispenser into the opening in the interior wall panel of the kitchen wall partition;

(F) connecting the first pipe end of the first connecting pipe to the water inlet of the pipe unit, and connecting the first pipe end of the second connecting pipe to the drain unit of the face panel; and (G) connecting the second pipe end of the first connecting pipe to the water inlet pipe of the sink unit, and connecting the second pipe end of the second connecting pipe to the drain pipe of the sink unit.

26. The method of claim 25, wherein:

a third through hole is formed in the interior wall panel in step (C);

a power cable is placed between the exterior and interior wall panels of the kitchen wall partition in step (D) such that first and second cable ends of the power cable are exposed from the interior wall panel of the kitchen wall partition via the opening and the third through hole, respectively;

the first cable end of the power cable is extended into the housing in step (E), and is connected to the control unit in step (F); and the second cable end of the power cable is connected to an electrical outlet on the interior wall panel of the kitchen wall partition in step (G).

27. The method as claimed in claim 25, wherein said housing further has an abutment portion that protrudes from one edge thereof at said front side and that is for abutting against an outer surface of the interior wall panel of the kitchen wall partition.

28. The method as claimed in claim 25, wherein the face panel is detached from the housing in step (E) and is attached to the housing after step (F).

29. The method of claim 28, further comprising fastening the housing to the posts of the kitchen wall partition through fasteners before reattaching the face panel to the housing.

* * * * *